US007632038B2

(12) United States Patent
Buschmann et al.

(10) Patent No.: US 7,632,038 B2
(45) Date of Patent: Dec. 15, 2009

(54) METHOD FOR PRODUCING A CONTINUOUS BONDING AGENT CARPET AND ROAD FINISHER

(75) Inventors: Martin Buschmann, Neustadt (DE); Karl-Heinz Schaefer, Korb (DE); Arthur Braun, Deidesheim (DE); Guenter Zegowitz, Mannheim (DE)

(73) Assignee: Joseph Voegele AG, Mannheim (DE)

( * ) Notice: Subject to any disclaimer, the term of this patent is extended or adjusted under 35 U.S.C. 154(b) by 0 days.

(21) Appl. No.: 11/924,740

(22) Filed: Oct. 26, 2007

(65) Prior Publication Data

US 2008/0124173 A1 May 29, 2008

(51) Int. Cl.
*E01C 19/16* (2006.01)

(52) U.S. Cl. ..... 404/111; 404/101

(58) Field of Classification Search ..... 404/111, 404/118, 101, 108

See application file for complete search history.

(56) References Cited

U.S. PATENT DOCUMENTS 2,372,065 A 3/1945 Etnyre
5,050,771 A * 9/1991 Hanson et al. ..... 222/1

FOREIGN PATENT DOCUMENTS

| | | |
|---|---|---|
| DE | 3942496 | 6/1991 |
| DE | 4101417 | 10/1991 |
| DE | 9317124 U1 | 3/1995 |
| DE | 29510058 | 11/1995 |
| EP | 0484236 | 5/1992 |

* cited by examiner

*Primary Examiner*—Raymond W Addie
(74) *Attorney, Agent, or Firm*—Darby & Darby P.C.

(57) ABSTRACT

A road finisher F for producing a continuous sprayed carpet T of a bonding agent on a planum has a spraying system S on a vehicle having at least two spraying facilities 11, 11', 14, 14' which are located offset to each other in the and laterally to the traveling motion direction R and a control device which operates the spraying facilities using a method such that during a traveling motion of the vehicle a sprayed carpet T is produced with front and rear boundaries V, H which are continuous over the width of the sprayed carpet and which are parallel to a respective reference line L which is placed on the planum in front of the spraying facility which is the frontmost in traveling motion direction. The sprayed carpet T is produced such that each spraying facility 11, 11', 14, 14' first is activated or deactivated depending on the traveling motion with a predetermined distance from the or when reaching the respective reference line L.

12 Claims, 2 Drawing Sheets

METHOD FOR PRODUCING A CONTINUOUS BONDING AGENT CARPET AND ROAD FINISHER

CROSS REFERENCE TO PRIOR APPLICATION

This application claims priority from European Patent Application No. 06024536.2, filed Nov. 27, 2006, the disclosure of which is incorporated herein by reference in its entirety.

FIELD OF THE INVENTION

The invention relates to a road finisher and a method of operation, such finisher to produce a rectangular sprayed carpet of a bonding agent on a surface.

BACKGROUND OF THE INVENTION

The road finisher known from EP 0 484 236 A includes spraying facilities which are lateral bars distributed over the longitudinal extension of the road finisher. The spraying facilities are also offset laterally to the longitudinal axis of the road finisher, in order to e.g. produce three strip-shaped sprayed lanes which result behind the road finisher in a laterally continuous carpet. A first spraying bar is arranged in front of the undercarriage and sprays the planum between the travelling lanes of the undercarriage. Secondary spraying facilities are arranged behind the undercarriage in the rear section of the road paver in order to spray the travelling lanes. Third spraying facilities are arranged at the outer sides of the travelling lanes, in particular, in longitudinal direction between the front side and rear side spraying facilities in order to spray regions within the total working width outside of the undercarriage. The sprayed carpet is combined like a mosaic of single rectangular or parallelogram shaped sprayed fields, since the spraying facilities are moved in reciprocating fashion and since the spraying nozzles are deactivated when reversing the direction of movement. As the spraying system is constructed such that all spraying facilities are activated at the same time when starting a spraying process and are deactivated at the same time when a spraying process is terminated, a sprayed carpet results from the offset between the spraying facilities in travelling direction and lateral to the travelling direction, which sprayed carpet has front and rear boundaries which do not extend lineally and laterally to the travelling direction but define a profile with steps. However, as the front boundary and the rear boundary of the laid down cover layer extend lineally and straight laterally to the travelling direction of the road finisher, and since it has to be assured that the sprayed carpet extends over the entire working width to the front boundary and the rear boundary of the laid down cover layer, sections of the profiles having steps will remain without being covered by the laid down cover layer, due to the respective stepped profile of the front and rear boundaries of the sprayed carpet. This not only means a waste of bonding agent, but also an unnecessary pre-impregnation of the planum. For a new working start and when connecting a newly laid down cover layer to an earlier laid down cover layer, again a bonding agent has to be applied excessively with a stepped profile because the cover layer which has to be laid down, of course, needs fresh bonding agent over the working width in order to achieve a homogonous bonding effect. This multiplies the waste of the bonding agent. In order to overcome this drawback in practice the respective stepped profile is completed manually by using spraying splash lances. The use of splash lances, however, in most cases results in locally excessively sprayed down bonding agent, which then rather will act as a separation layer for the laid down cover layer (bonding faults) than a bonding layer. Furthermore, the use of the splash lances means undesirable environmental contamination by bitumen stench and spraying fog.

The road finisher known from DE 41 01 417 A carries a selectively removable spraying system comprising spraying bars at low positions behind the undercarriage which spraying bars not only spray the basic width of the paving screed but also comprise extension beams which can be moved sidewardly outwardly or can be pivoted outwardly. Mounting and manipulation of the extension beams are necessary for spraying the outside regions of the working width may easily lead to problems. Furthermore, mounting the spraying facilities in this area of the road finisher between the rear end of the road finisher and the lateral distribution device in front of the paving screed cause complicated space problems.

In the spraying road finisher known from DE 93 17 124 U different spraying facilities are mounted such that they are offset to each other in longitudinal direction and lateral direction of the road finisher. Secondary aggregates like pumps and filters common to all spraying facilities are mounted in a free space of the chassis. As soon as the secondary aggregates are switched on all spraying facilities are supplied at the same time with the bonding agent, and all spraying facilities start spraying processes at the same time. Due to the offset between the spraying facilities and the simultaneous activation or deactivation a stepped profile is produced at the front and rear boundaries of the sprayed carpet. This stepped profile does not fit to the linear an straight lateral front and rear boundaries of the laid down cover layer.

A distributing apparatus for bituminous material according to U.S. Pat. No. 2,372,065 A has a main bar extending laterally to the travelling direction. The main bar contains several spraying nozzles. At both ends of the main bar additional beams having nozzles are linked in pivotable fashion in order to vary the spraying width by a pivoting motion of the beams. Only when the beams are fully pivoted outwardly, a straight front boundary of the sprayed carpet can be achieved which extends laterally to the travelling direction. Whenever the working width is smaller than the full maximum working width the front boundary or the rear boundary of the sprayed carpet cannot be straight, lineal and lateral to the travelling direction. All nozzles are simultaneously supplied with bituminous material via a common valve assembly and a common pump activated or deactivated for a spraying process.

BRIEF DESCRIPTION OF THE INVENTION

It is an object of the invention to provide a method and a road finisher designed for carrying out the method which allow to produce a substantially ideal rectangular sprayed carpet having continuous straight and lineally front and rear boundaries despite given offsets between the spraying facilities and without cumbersome manual work, without wasting bonding agent, and without an unnecessary contamination of the planum.

Since according to the method each spraying facility first is activated depending on the travelling movement when it has a predetermined distance to or is reaching the reference line set beforehand, the front boundary as well as the rear boundary of the sprayed carpet will be straight and lineally and parallel to the reference line. In this way the front and rear carpet boundaries will substantially coincide with the front and rear boundary of the laid down layer, without wasting bonding agent or without unnecessary contamination of the planum.

Of course, in practice, a certain overlap is made, i.e., the front and rear boundaries of the sprayed carpet will be situated a little in front of the front boundary and a little behind the rear boundary of the laid down layer, in order to prevent regions of the laid down cover layer from not bonding properly. Any manual work is eliminated which in most cases meant a wrong dosing of the bonding agent and an undesirable environmental load.

The road paver is equipped with a control device designed such that the spraying facilities are activated or deactivated sequentially, whenever a respective spraying facility reaches the predetermined distance to or the reference line. The control device may be the control device of the road paver, or may be a control device for the spraying system which control device, preferably, is communicating with the control device of the road finisher. The reference line is set, preferably, also when the cover layer is laid down, in particular when forming the front boundary and the rear boundary of the laid down cover layer. This means that in practice two reference lines are set, namely before starting and terminating a working cycle.

According to an expedient variant of the method a spraying facility aligned at 90 degrees with respect to the travelling motion direction and having several spraying nozzles which are distant from each other in longitudinal direction of the spraying facility, is activated or deactivated such that all spraying nozzles start or terminate a spraying cycle at the same time. In this fashion this spraying facility produces one section of the front and the rear boundary of the sprayed carpet, which section extends straight, linear and lateral to travelling direction.

According to another expedient variant of the method each spraying facility which can be aligned at an angle different from 90 degrees with respect to the travelling direction and which has at least one spraying nozzle, preferably several spraying nozzles which are distant from each other in longitudinal direction of the spraying facility, is activated or deactivated such that each spraying nozzle starts and terminates a spraying cycle alone at the predetermined distance from the or at the reference line. In this fashion again one section of the front or rear boundary of the sprayed carpet is produced which section is straight, linear and lateral to the travelling direction, despite the alignment angle of this spraying facility which is different from an angle of 90 degrees with respect to the travelling direction. This is achieved irrespective of the actual angle at which this spraying facility is aligned at this moment with respect to the travelling direction.

Expediently, and in order to allow to precisely control the point in time of the activation or the deactivation, the distance or the path to the reference line is measured whenever a spraying facility which is aligned at 90 degrees with respect to the travelling direction is activated or deactivated.

To the contrary, and for activating or deactivating a spraying facility which can be aligned at an angle which is different from an angle of 90 degrees with respect to the travelling direction, the distance or the path of each spraying nozzle is measured with respect to the reference line. In some cases also the angle of alignment of the spraying facility is measured and the position of the spraying nozzle with respect to the reference line is determined, in order to accurately time the activation or deactivation. This may, expediently, be carried out automatically by the control device, such that the operator does not have to take care of control steps, or even is triggered by an operator. In this case, of course, preferably, the method is carried out depending on the selected spraying working width as adjusted by the angle of alignment of the spraying facility, since the selected working width is decisive for the angle of alignment. Expediently, a variable dosing or metering of the bonding agent is carried out such that the amount per time as applied by each spraying nozzle is reduced in case of a smaller working width and in case of a small angle of alignment, as for a smaller angle of alignment the spraying nozzle overlap each other more in travelling direction than in case of a larger angle of alignment.

Expediently, the method is carried out such that first the reference line is placed virtually but stationarily on the planum. Then, preferably by means of a screen, the respective target value for the travelling speed, the working width, the spraying amount per surface unit, and the like, is input in the spraying control device. Then the spraying system is switched into a standby condition. Thereafter, the vehicle starts to move. As soon as the travelling movement has started, the respective spraying facility is automatically activated at the predetermined distance from the or at the reference line. At the end of the production of the sprayed carpet the procedure is carried out in inverse fashion such that first again the reference line is placed virtually, and that then the spraying facilities are deactivated sequentially with respect to the reference line.

In this case it is expedient when the bonding agent is heated up in controlled fashion and is circulated in the spraying facility prior to the start of the vehicle. During this preparation phase a release signal is awaited depending on a control check of target values. The release signal is first emitted when all adjustments have been checked at a control device and have been found to be in order. Then the vehicle is started and also the spraying process is initiated in the above-mentioned fashion.

At an end of a spraying process, preferably, after the sequential deactivation of the spraying facility, either automatically or guided by an operator, a pressurised air cleaning cycle and emptying cycle at least of the spraying facilities is carried out. In this fashion clogging of the spraying facilities during an unexpectedly longer break is prevented.

Furthermore, it is expedient to fixedly or removably integrate the spraying system into a road finisher having a paving screed and defining the vehicle. With the road finisher a surface layer is laid down continuously starting with a substantially line-shaped front boundary and ending at a substantially line-shaped rear boundary, which boundaries are straight, linear and lateral to the travelling direction. In this case, the front boundary and the rear boundary also may be used as the respective reference line for activating and deactivating the spraying facilities. Preferably, however, the front and rear boundaries of the sprayed carpet are produced with a predetermined distance in front of the front boundary and somewhat behind the rear boundary of the laid down cover layer. It is, furthermore, expedient to produce the sprayed carpet in lateral direction somewhat broader than the laid down cover layer.

In a particularly comfortable fashion the respective reference line is placed on a screen of the control device, which screen displays an image of the travelling path. Thereafter, i.e. after the start of the travelling motion, the approach of the spraying facility to the reference line is monitored until the activation or deactivation takes place. This can be carried out guided by a computer automatically or even by an operator.

An expedient embodiment of a road finisher is characterised in that in the spraying system a first spraying facility is arranged at an angle of 90 degrees with respect to the longitudinal axis of the road finisher in the front region of the road finisher. The first spraying facility serves to spray the intermediate space between the travelling lanes of an undercarriage. Two further spraying facilities are arranged at an angle of 90 degrees with respect to the longitudinal axis of the road finisher in the rear region behind the travelling lanes in order to spray the uncovered travelling lanes which have been left free by the first spraying facility. Furthermore, two spraying facilities are provided outside the travelling lanes between the front region and the rear region of the road finisher. These spraying facilities either can be displaced laterally to the longitudinal axis of the road finisher or can be pivoted in relation to the longitudinal axis of the road finisher. Each of these spraying facilities comprises several spraying nozzles which are distributed in the longitudinal direction of the respective spraying facility. The spraying nozzles can be actuated one by one, sequentially, in groups, or commonly, and in some cases cyclically. The above-mentioned distribution of the spraying facility has the advantage of allowing to use regions for the spraying facilities at the road finishers which regions offer good access. This means that only very small spraying facilities have to be arranged in the working region with obstructed access between the rear region of the chassis and the lateral distribution device in front of the paving screed. However, by using all these spraying facilities a sprayed carpet of arbitrary width can be provided, which despite the given offsets between the spraying facilities has straight and linear front and rear boundaries of the sprayed carpet lateral to the travelling direction.

In the case of pivotable spraying facilities, expediently, angle sensors are associated to the spraying facilities, which angle sensors are connected to the control device, in order to allow to properly control the pivot movements, to allow to vary the dosing depending on the angle, and to allow to precisely determine the position of each spraying nozzle in relation to the reference line.

Expediently, a distance measuring device is connected to the control device. The distance measuring device also may be used for the activation and deactivation of the spraying facilities.

Finally, also a device for adjusting and detecting the travelling speed ought to be provided and connected to the control device because, of course, the activation and deactivation of the spraying facilities is carried in dependence from the travelling speed, and because also metering or dosing of bonding agent has to consider the momentary travelling speed.

BRIEF DESCRIPTION OF THE DRAWINGS

Embodiments of the invention will be explained with the help of the drawings. In the drawings is.

DETAILED DESCRIPTION OF THE INVENTION

Figure 1:
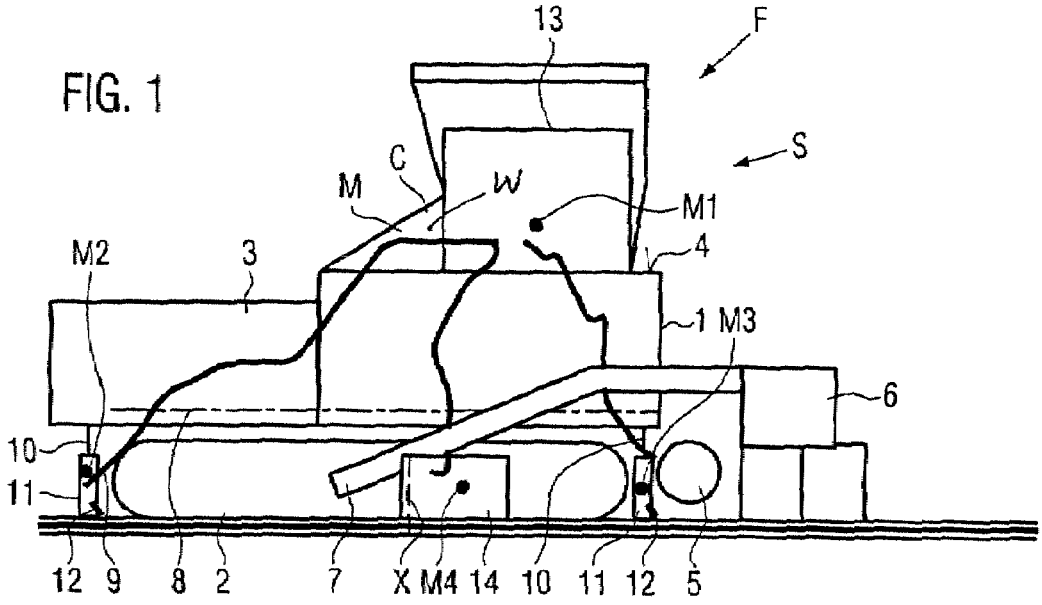
FIG. 1 a schematic side view of a road finisher having mounted spraying nozzles for casting a bituminous cover layer on a continuous sprayed carpet of a bonding agent like a bitumen emulsion, FIG. 2 a schematic top view associated to FIG. 1, FIG. 3 a schematic top view associated to FIG. 1, to explain the method for producing the sprayed carpet, and FIG. 4 a top view of the covered layer on the sprayed carpet.

A road finisher F, in particular, a standardised road finisher, e.g. for smaller working widths, has a chassis 1 at which at the lower side an undercarriage 2 is provided (either, as shown, a caterpillar track undercarriage, or, as not shown, a wheeled undercarriage). A material hopper 3 is arranged at the front end of the chassis 1. A conveying device 8 (e.g. a slat conveyor or two adjacent slat conveyors) extends from the lower side of the material hopper 3 through the chassis 1 to the rear end of the chassis 1. A primary drive source M and an electronic control device C are arranged on the chassis 1 at an operator platform 4. Behind the rear end of the chassis 1 a lateral distribution device 5 is mounted, e.g. a distributing auger, behind which a paving screed 6 is situated which is linked by bars 7 to the chassis 1 and is towed by the road finisher F on a planum P.

Figure 2:
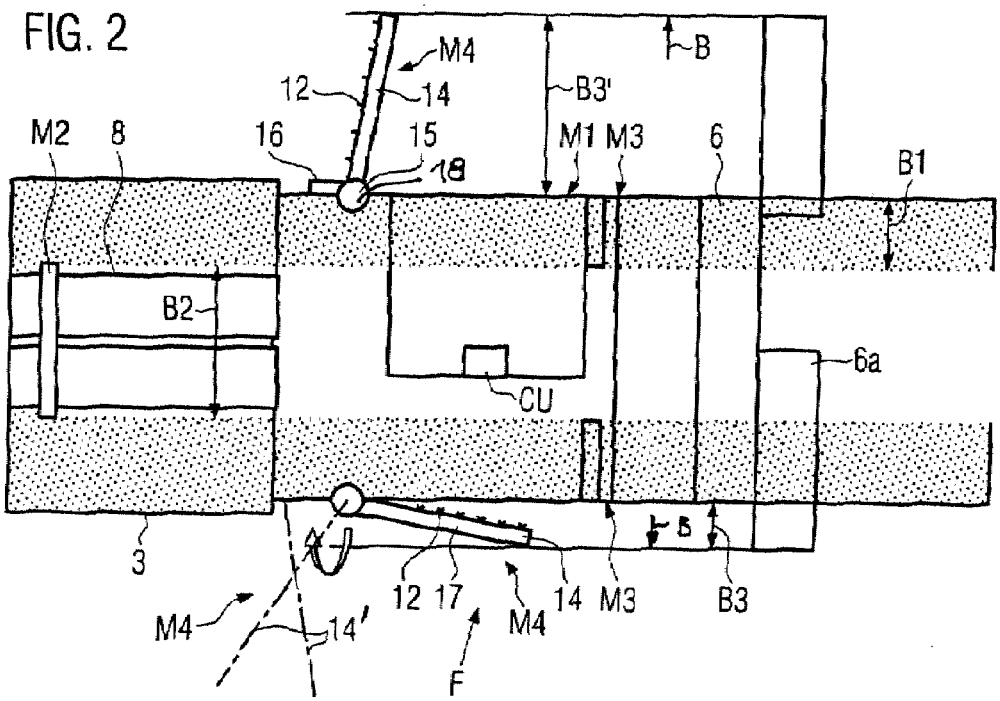

It is to be noted that the paving screed 6 is a so-called extension screed (as shown in FIG. 2), comprising a basic screed part and extension screed parts 6a, so that the working width B of the paving screed 6 is variable.

The road finisher F is completed by a removably arranged spraying system S, for a working case in which a bonding layer consisting of a bitumen emulsion has to be applied on the planum. In the case that the road finisher is used for working procedures which do not need a bonding layer, the spraying system S either is non-functional or is removed in part or totally.

The spraying system S comprises a first spraying module M1 situated on the operator's platform 4, in particular, e.g. offset sidewardly with respect to the centre of the operator's platform 4. The first spraying module M1 contains components among others for storing, heating, filtering, circulating and for deploying of the bitumen emulsion, and for a pressurised air cleaning cycle, and e.g. is formed as a block 13. A spraying control device CU, e.g. an electronic spraying control device, may be provided in the first spraying module M1. Alternatively, the spraying control device CU also could be mounted at another location in the road finisher F, or could even be integrated into the control device C. The first spraying module M is connected via not shown connection cables with the drive supply of the road finisher F, in order to receive hydraulic and/or mechanical and/or electric and/or electronic driving power from the road finisher. In a not shown embodiment, however, the first spraying module M1 could to the contrary be autarkic and could have its own drive source.

A second spraying module M2 is attached at the chassis 1 below the material hopper 3, more precisely in the region of the front end of the conveying device 8. The second spraying module M2 is secured with fixing means 10. The fixing means 10, in some cases, may be mounted at the road finisher F. The second spraying module M2 has as a spraying facility a laterally extending spraying bar 11 equipped with spraying nozzles 12. The second spraying module M2 is connected via piping 9 with the first spraying module M1. The piping may be installed inside the road finisher or outside. The spraying bar 11 applies the bitumen emulsion on the planum only within the width between the travelling lanes of the undercarriage 2 such that the undercarriage 2 does not travel in the sprayed bitumen emulsion.

A third spraying module M3 is mounted behind the undercarriage 2 and below the chassis 1. The third spraying module M3 has as spraying facilities two spraying bars 11' each equipped with spraying nozzles 12. The spraying bars 11' only spray on the travelling lanes of the undercarriage 2, such that a finally applied bonding layer on the planum and in the region of the lateral distribution device 5 covers the entire working width B of the road finisher F without any interruptions. In some cases, the bonding layer even may extend on both sides somewhat beyond the working width B.

As a consequence of the extension paving screed 6, 6a having a variable working width B, a fourth spraying module M4 may be provided within the longitudinal extension of the chassis 1 between the second and third spraying modules M2, M3, however, structurally separated from the second and third spraying modules. The fourth spraying module M4 is equipped with spraying bars 14 constituting further spraying facilities at the outer sides of the undercarriage 2. The spraying bars 14 either are attached to the undercarriage 2 or to the chassis 1. The fourth spraying module M4 has, according to FIG. 2, a single spraying bar 14 per side, which spraying bar is pivotable by an actuator 16 about a substantially perpendicular axis 15 between a position in which the spraying bar 14 is pivoted close to the outer side of the undercarriage and an extended position in which it is pivoted outwardly. The fourth spraying module M4 deploys the bitumen emulsion on the planum within the remaining part of the working width B, i.e., on regions B3 or B3' outside of the undercarriage 2.

The spraying nozzles 12 at least in the spraying bars 14, expediently are operated with the help of closure organs or valves 17, and are e.g. operating in cycles. The spraying nozzles 12 may be operated in cycles at the same time or cascade-like. The valves or closure elements 17 even may be arranged in the piping 9 or even in the first spraying module M1. In some cases, the spraying bars 11, 11', 14 only may have the function of carriers of the spraying nozzles 12 supplied either one by one or in groups.

The spraying control device CU is designed such that the bitumen emulsion is metered individually depending on the pivot position of each spraying bar 14, i.e., the strongest dose is applied when the spraying bar 14 is pivoted outwardly the furthest, and vice versa. Basically, dosing or metering is carried out in dependence from the travelling speed of the road finisher F when casting a cover layer, in order to produce a uniform, continuous bonding layer which is as thin as possible. Metering of the bitumen emulsion is expedient, because the spraying nozzles 12 at the spraying bars 14 overlap each other with their spraying jets the more lateral to the working travelling direction the further the spraying bar 14 is pivoted towards the outer side of the undercarriage 2. Due to this then strong overlap the spraying nozzles 12 would apply more bonding agent per surface unit than the other spraying bars 11, 11'. For this purpose angle sensors 18 are installed which are connected to the control device.

A modified embodiment indicated in dotted lines in FIG. 2 has instead of a single spraying bar 14 per side in the fourth spraying module M4 two spraying bars 14' per side. These two spraying bars 14' are pivoted outwardly and inwardly like a scissor mechanism. The axes X of the spraying bars 14' are substantially vertical and are supported as close as possible to the chassis 1. As the spraying nozzles 12 at the spraying bars 14, 14' of the fourth spraying module M4 are arranged at fixed distances in the longitudinal direction of the spraying bars, and since the distance between the spraying nozzles 12 varies laterally to the travelling direction depending on the scissor pivot position, the spraying control device CU compensates a variation of the spraying amount per surface unit by metering depending on the scissor pivot angle.

Cycling of the spraying nozzles 12, e.g. by valves, is carried out such that each spraying nozzle either is fully opened or fully closed. The timewise relation (duty ratio) between the closing time and the opening time can be varied to influence the applied amount per surface unit. Alternatively, even the degree of opening of the spraying nozzles 12 could be varied.

By means of this sophisticated spraying control a sprayed carpet of the bonding agent can be produced very uniformly and precisely with the correct dose per surface unit just sufficient to achieve an optimal bonding effect. This advantage significantly increases the acceptance of such spraying road finishers with road construction authorities, because these authorities have until now tended to refuse to use a bonding agent because of the environmental contamination and, mainly because of local bonding faults of the cover layer due to over or under dosing.

The spraying facilities 14 shown in FIG. 2 (spraying bars having spraying nozzles 12, or nozzle carriers with supply lines to the spraying nozzles) could be arranged in an alternative embodiment laterally with respect to the travelling direction R, and such that they move in reciprocating fashion.

Figure 3:
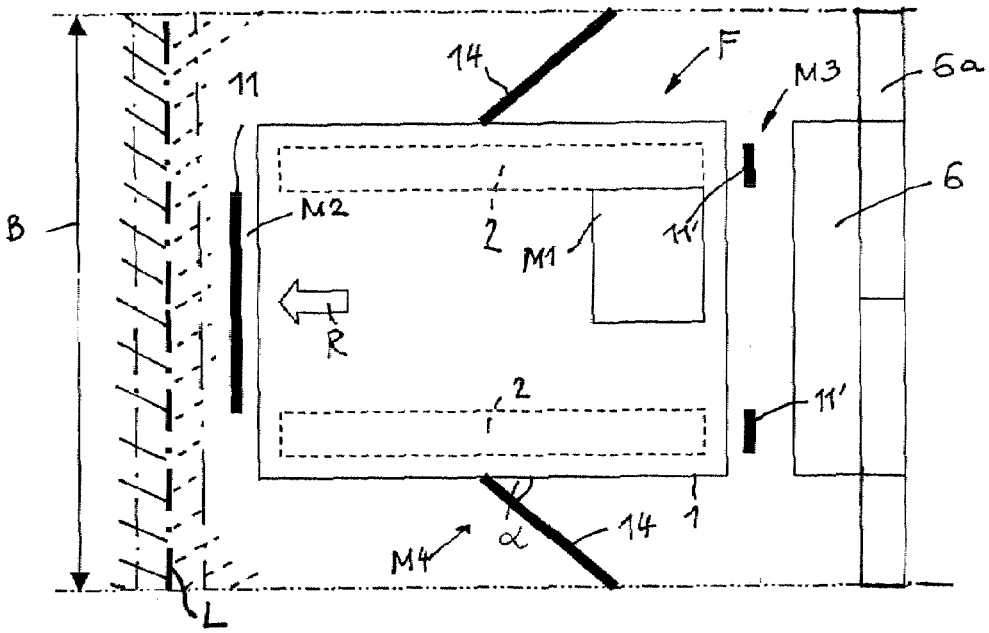
Figure 4:
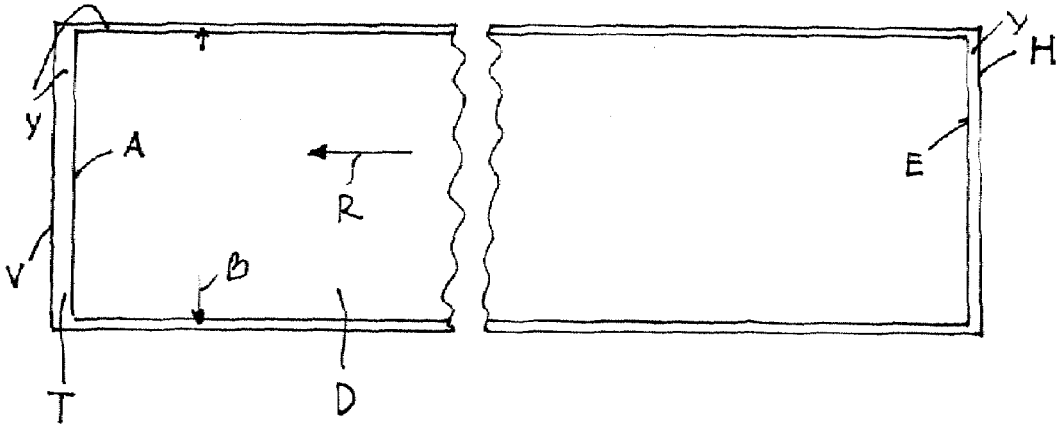

FIG. 3 indicates in a schematic top view of the vehicle, e.g. of the road finisher F of FIGS. 1 and 2, showing how the spraying system is controlled either manually or automatically, in order to produce a relatively precise rectangular sprayed carpet T on an exemplary straight path in FIG. 4. FIG. 4 indicates a of construction site consisting of a cover layer D laid down on the sprayed carpet T on the planum. In case of this exemplary straight path the sprayed carpet T as well as the cover layer D both have an exact rectangular shape. Preferably, however, not necessarily, the sprayed carpet T may have a lateral excess size Y in order to ensure that the edge regions of the cover layer D will also be bonded properly. The sprayed carpet T has a front boundary V which is straight and linear and extends continuously laterally with respect to the travelling motion direction R, and a rear boundary H which also extends lateral to the travelling motion direction and is straight and linear within the working width B. In an analogous fashion the cover layer D is laid down with a front boundary A which is straight and lineal and extends continuously laterally with respect to the travelling motion direction R over the entire working width B, as well as such a rear boundary E.

In order to produce the sprayed carpet T with the above-described shape and despite the fact that the spraying facilities 11, 11', 14, 14' are offset to each other both in the travelling motion direction R and lateral to the travelling motion direction R, the method according to the invention is carried out either automatically or guided by an operator. This is explained with the help of FIG. 3.

Before the road finisher F constituting the vehicle having the spraying system S starts to move, a reference line L is placed on the planum in front of the spraying facility 11 which is the frontmost in travelling motion direction R (or in some cases directly below the spraying facility 11). This is e.g. made on a screen in the control device C or CU. Beforehand, already target values for e.g. the travelling speed during work, the working width B and the spraying amount per surface unit, and the like, are input into the control device. In the case that the bonding agent, e.g. a bitumen emulsion, should not already have been heated sufficiently, then the bonding agent is first heated up, expediently by regulating the working temperature. Subsequently the bonding agent is circulated in the spraying system S. Then a release signal for a spraying operation is generated. Subsequently, e.g. by the control device, a check of all parameter settings is carried out such as the temperature, the pressure, the circulation of the bonding agent, the dosing, and the set travelling speed. The positive result of such a check gives a release signal which is displayed for the operator. Thereafter, the road finisher F is started, or if already started, is brought into motion. Then also the spraying operation is on stand-by, in the spraying system S, however, without carrying out any spraying cycles yet.

First when the spraying facility 11 being the frontmost in travelling motion direction R has reached a predetermined distance to the reference line L or has reached the reference line L, spraying cycles are started from the spraying nozzles of the spraying facility 11. The other spraying facilities 11', 14, 14' still remain deactivated, while the vehicle travels further.

In dependence from the travelling speed, which is monitored e.g. by counting gear wheel pulses at a hydro-motor of the travelling gear, or which is measured by means of another distance measuring system or with the help of a GPS-system, and also in dependence on the set working width B, the position of each single spraying nozzle 12 of the spraying facilities 14 is detected, also by using the information from the angle sensors, when reaching the reference line L or with the predetermined distance in front of the reference line or behind the reference line. Then the respective spraying nozzles 12 are activated such that each spraying cycle starts exactly at the reference line. The spraying facilities 11' still are deactivated then. Only if during the further travel of the vehicle finally the spraying facilities 11' reach the predetermined distance from the or the reference line L, as monitored by means of a distance measuring system, also the spraying facilities 11' are activated such that they exactly start the spraying cycles at the reference line L.

In this fashion a sprayed carpet T is produced which corresponds with the current working width B. Also the position of the front of the paving screed 6, **6*a* is controlled to start work at the reference line L, expediently such that the front boundary A of the laid down cover layer D, as shown in FIG. 4**, will be placed a short distance behind the front boundary V of the sprayed carpet T.

When work is finished or a stop is planned, or if the work has to be interrupted, the spraying facilities 11, 11', 14, 14' are deactivated according to an inverted sequence in order form the rear boundary H. Finally also the cover layer D is stopped there such that the rear boundary E will remain in working travelling direction somewhat in front of the rear boundary H of the sprayed carpet T. This means that corresponding to the above-described working method the spraying nozzles 12 and/or spraying facilities 11' are activated and deactivated one by one and depending on the travelling motion.

The method may be carried out automatically by the control device automatically, e.g. guided by a computer, or by an operator who monitors the method step visually, e.g. on the screen and in parallel by sight, and which then inputs the corresponding commands manually at respective points in time.

After work has ended, expediently, all spraying facilities are blown out and cleaned by a pressurised air cleaning cycle which is initiated manually or by means of a program routine automatically.

The invention claimed is:

1. Road finisher comprising:

a vehicle having a vehicle chassis travelling with an undercarriage on a planum; and a bonding agent spraying system on the vehicle chassis, the spraying system comprising:

at least two spraying facilities each for producing a continuous sprayed generally rectangular carpet on the planum, which at least two spraying facilities are offset to each other laterally to the vehicle travelling motion direction with at least one spraying facility in a front region of the vehicle and at least one spraying facility in a rear region of the vehicle behind the undercarriage, each spraying facility having at least a spraying nozzle; and a control device for setting a reference line transverse to the vehicle travelling direction at each of the start and end of the carpet to be sprayed, the control device selectively activating and deactivating the at least two spraying facilities in sequence to produce the sprayed carpet with front and rear boundaries which are continuous over the working width of the sprayed carpet and extend parallel to a respective reference line which is in front of or directly below the spraying facility which is the frontmost on the vehicle in the travelling motion direction by the control device for selectively activating and deactivating each spraying facility automatically and depending on the travelling motion first when the respective spraying facility in the front or rear regions of the vehicle has reached one of a predetermined distance from the or reaches the respective reference line at each of the start and end of the carpet, wherein as the components of the spraying system comprise:

a first spraying facility arranged at an angle of 90° to the longitudinal axis of the road finisher in the front region of the road finisher for spraying an intermediate space between travelling lanes of an undercarriage, two further spraying facilities arranged at an angle of 90° with respect to the longitudinal axis of the road finisher in the rear region of the road finisher behind the travelling lanes to spray bonding agent on the travelling lanes, and two further spraying facilities situated outside of the travelling lanes between the front region and the rear region of the road finisher, and which two further spraying facilities either can be displaced laterally with respect to the longitudinal axis of the road finisher or can be pivoted relative to the longitudinal axis of the road finisher about axes substantially perpendicular to the planum, and wherein each of the spraying facilities comprises a plurality of spraying nozzles which are distributed in longitudinal direction of the respective spraying facility and which can be operated, sequentially or commonly.

2. Road finisher according to claim 1, further comprising:

angle sensors associated to the two further pivotable spraying facilities, the angle sensors connected to the control device.

3. Method for producing a continuous sprayed carpet of generally rectangular shape of a bonding agent on a planum by a spraying system equipped vehicle with an undercarriage travelling on the planum, the spraying system having at least two spraying facilities and a spraying control device with the at least two spraying facilities arranged offset to each other laterally to the vehicle travelling motion direction and offset relative to the vehicle travelling motion direction with at least one spraying facility in a rear region of the vehicle and behind the undercarriage and at least one spraying facility in a front region of the vehicle, each spraying facility comprising at least one spraying nozzle, and a control device for at least activating and deactivating a spraying cycle by the nozzles of the at least two spraying facilities, comprising the steps of:

setting from within and for use within the vehicle a virtual straight first reference line in front of or directly below the frontmost spraying facility in the travelling motion direction of the vehicle to extend transverse to the travelling motion direction to set the start boundary of the carpet, the controller sequentially activating each of the spraying facilities in the front and rear regions of the vehicle in dependence on the vehicle travelling motion first when during the travelling motion a respective spraying facility is at a predetermined distance from the or is reaching the first reference line to produce a sprayed carpet such that it has a front boundary which is continuous over the lateral width of the sprayed carpet and parallel to the first reference line, setting from within and for use within the vehicle a virtual straight second reference line in front of or directly below the spraying facility which is the frontmost spraying facility in travelling motion direction by to extend transverse to the travelling motion direction to set the stop boundary of the carpet; and the controller sequentially deactivating each of the spraying facilities in the front and rear regions of the vehicle for producing during vehicle travelling motion a rear boundary for the sprayed carpet which is continuous over the lateral width of the sprayed carpet and parallel to the second reference line.

4. Method according to claim 3 further comprising the step of first setting each first and second respective reference line virtually;

inputting target values at least of the travelling speed, the working width, the spraying amount per surface unit, into the spraying control device, wherein the spraying system is in a standby condition; and upon the vehicle starting moving, activating the respective spraying facility which is next to the reference line with the predetermined distance or which is reaching the reference line.

5. Method according to claim 3, wherein a spraying facility which can be aligned at an angle different to an angle of 90° about an axis which is about perpendicular to the planum with respect to the travelling motion direction and having a plurality of spraying nozzles which are spaced from each other in a longitudinal direction of the spraying facility, further comprising the step of the control device activating and deactivating said plurality of spraying nozzles such that each of the spraying nozzles activated or deactivated by the controllable member starts or terminates a spraying cycle at a predetermined distance from the or when reaching the reference line.

6. Method according to claim 5 wherein the control device controls the activation or deactivation of each spraying facility which can be aligned at an angle different to an angle of 90° with respect to the travelling motion direction and about an axis about perpendicular to the planum automatically or guided by an operator via a measurement of the distance to a reference line and via measurement of the angle of the alignment of the spraying facility or via a position detection of each spraying nozzle with respect to the reference line, and depending on the working width as adjusted by means of the angle of alignment of the spraying facility.

7. Method according to claim 3 wherein the spraying system is integrated fixedly or removably into a road finisher having at least one paving screed and constituting the vehicle by which during a travelling motion starting at a substantially line-shaped front boundary to a substantially line-shaped rear boundary, each respectively extending lateral to the travelling motion direction, a cover layer is laid down continuously, and further comprising the steps of using the front boundary or the rear boundary of the laid down cover layer as the respective reference line for activating or deactivating the spraying facilities, and producing the rear and the front boundaries of the sprayed carpet with a predetermined distance in front of the front boundary and behind the rear boundary of the laid down cover layer.

8. Method according to claim 7, further comprising the steps of:

placing the respective reference line virtually on a screen of the control device which screen displays the travelling path, and after the start of the travelling motion monitoring the movements of the spraying facilities to the reference line until spraying facility activation or deactivation takes place.

9. Road finisher, comprising:

a vehicle having a vehicle chassis travelling with an undercarriage on a planum; and a bonding agent spraying system on the vehicle chassis, the spraying system comprising:

at least two spraying facilities each for producing a continuous sprayed generally rectangular carpet on the planum, which at least two spraying facilities are offset to each other laterally to the vehicle travelling motion direction and offset relative to the vehicle motion travelling direction with at least one spraying facility in a front region of the vehicle and at least one spraying facility in a rear region of the vehicle behind the undercarriage, each spraying facility having at least a spraying nozzle; and a control device for setting from within and for use within the vehicle a respective reference line transverse to the vehicle travelling direction at each of the start and end of the carpet to be sprayed, the control device selectively sequentially activating and deactivating the at least two spraying facilities in sequence to produce the sprayed generally rectangular carpet with front and rear boundaries which are respectively continuous over the working width of the sprayed carpet and extend parallel to a respective reference line which is in front of or directly below the spraying facility which is the frontmost on the vehicle in the travelling motion direction by the control device for selectively sequentially activating and deactivating each spraying facility automatically and depending on the travelling motion first when the respective spraying facility in the front or rear regions of the vehicle has reached one of a predetermined distance from the or reaches the respective reference line at each of the start and end of the carpet.

10. Road finisher according to claim 9, further comprising:

a distance measuring device for the travelling distance, the distance measuring device being connected to the control device.

11. Road finisher according to claim 9, wherein as the components of the spraying system comprise:

a first spraying facility arranged at an angle of 90° to the longitudinal axis of the road finisher in the front region of the road finisher for spraying an intermediate space between travelling lanes of an undercarriage, two further spraying facilities arranged at an angle of 90° with respect to the longitudinal axis of the road finisher in the rear region of the road finisher behind the travelling lanes to spray bonding agent on the travelling lanes, and two further spraying facilities situated outside of the travelling lanes between the front region and the rear region of the road finisher, and which two further spraying facilities either can be displaced laterally with respect to the longitudinal axis of the road finisher or can be pivoted relative to the longitudinal axis of the road finisher about axes substantially perpendicular to the planum, and wherein each of the spraying facilities comprises a plurality of spraying nozzles which are distributed in longitudinal direction of the respective spraying facility and which can be operated, sequentially or commonly.

12. Road finisher according to claim 11, further comprising:

angle sensors associated to the two further pivotable spraying facilities, the angle sensors connected to the control device.

* * * * *

UNITED STATES PATENT AND TRADEMARK OFFICE

CERTIFICATE OF CORRECTION

PATENT NO. : 7,632,038 B2
APPLICATION NO. : 11/924740
DATED : December 15, 2009
INVENTOR(S) : Martin Buschmann et al.

It is certified that error appears in the above-identified patent and that said Letters Patent is hereby corrected as shown below:

On the title page add item (30), "Foreign Application Priority Data"

-- November 27, 2006 (EP) .....06024536 --

Signed and Sealed this

Sixteenth Day of February, 2010

David J. Kappos

David J. Kappos
*Director of the United States Patent and Trademark Office*